United States Patent [19]

Kohler

[11] 4,219,147

[45] Aug. 26, 1980

[54] SIX CELL GLASSWARE CARTON

[75] Inventor: Karl A. Kohler, Roselle, Ill.

[73] Assignee: Champion International Corporation, Stamford, Conn.

[21] Appl. No.: 32,728

[22] Filed: Apr. 23, 1979

[51] Int. Cl.[2] ..... B65D 5/48

[52] U.S. Cl. ..... 229/27; 229/41 B

[58] Field of Search ..... 229/27, 28, 41 B, 41 R

[56] References Cited

U.S. PATENT DOCUMENTS

| | | | |
|---|---|---|---|
| 3,118,589 | 1/1964 | Hughes | 229/27 |
| 3,184,143 | 5/1965 | Kotowick | 229/41 B X |
| 3,685,640 | 8/1972 | Tolaas | 229/27 X |
| 3,836,065 | 9/1974 | Hackenberg | 229/15 X |
| 3,921,894 | 11/1975 | Hackenberg | 229/27 |
| 3,941,302 | 3/1976 | Tyrseck | 229/15 X |
| 3,952,941 | 4/1976 | Zimmerman | 229/27 X |

*Primary Examiner*—Davis T. Moorhead

*Attorney, Agent, or Firm*—Evelyn M. Sommer

[57] ABSTRACT

A six celled collapsible carton formed from a single cardboard blank which includes an automatic locking bottom and dividers which extend the entire height of the box. The carton is provided with four L-shaped dividers, two of which further include a central tab, spaced from both the top and bottom edges of the divider, for fixedly connecting an associated alternate divider to form a pair of cross-shaped divider members. One section of each pair of cross-shaped divider members overlaps to form a central wall. The side edge of each overlapping section is provided with a notch for creating an interengagement between the sections to add structural rigidity to the central wall. The side edges of the overlapping sections further include an arcuately shaped portion above the notches to facilitate the interengagement between the sections. The carton can be shipped in a flattened configuration and can be readily erected.

13 Claims, 5 Drawing Figures

SIX CELL GLASSWARE CARTON

The subject invention relates to a collapsible six-cell carton and a blank for forming same. More particularly, a carton is provided which can be shipped from the manufacturer in the knocked-down flattened configuration, and which can be readily erected by the purchaser.

The subject carton is intended for use in shipment and storage of fragile articles. Therefore, dividers are provided to section the carton into six compartments so that each article is protected during shipment and storage. Further, to minimize cost, the carton is manufactured from a single cardboard blank which is capable of being shipped from the manufacturer in a knocked-down flattened configuration.

Prior art containers which are of the knockdown variety are provided with dividers having slots running therethrough such that alternate dividers could be received through these slots when erecting the carton. This arrangement required that the dividers which were to be inserted in these slots be of a lesser height than the other dividers and necessarily could not extend the full height of the carton. Since some of the dividers did not extend the full height of the carton, the fragile articles within could come into contact with each other thus causing breakage. Some prior art cartons have every divider extend the full height of the carton, this being accomplished by either extending the slots of the dividers into the bottom wall of the carton or by extending the slotted divider to a height greater than the height of the box. However, any slot which runs essentially the length of the divider must necessarily weaken the divider, which reduces the structural integrity of the carton. Further, if the slot is extended into the base of the carton, the carton floor is weakend. On the other hand, when the dividers are extended to a height greater than the carton, not only are the dividers structurally weakened by the slots, but the additional height would prevent the easy closure of the carton.

Accordingly, it is an object of the subject invention to provide a collapsible carton which has dividers that extend the full height of the container.

It is a further object of the subject invention to provide a collapsible carton with dividers having a high structural rigidity.

It is another object of the subject invention to provide a collapsible carton which can be shipped in a knocked down flattened configuration.

It is still a further object of the subject invention to provide a collapsible carton with dividers having high structural rigidity that can be automatically erected and provide protection to the fragile articles within.

In accordance with these and many other objects, the subject invention provides a carton formed of a one piece cardboard blank, with dividers that extend the full height of the carton. Two pairs of L-shaped dividers are provided with the dividers of each pair being in abutting relation along their respective hinged axis such that each pair forms a cross-like configuration. The two L-shaped dividers of each pair are adhesively bonded to each other by means of a central tab which is spaced from the top and bottom of said dividers. Each cross-like pair of dividers are disposed such that one section of one pair overlaps one section of the other pair to form a central wall. The side edge of each overlapping section is provided with a notch for creating an interengagement between the sections, such that the structural rigidity of the central wall is increased. The side edge of each overlapping section further includes an arcuately shaped portion above each notch to facilitate the interengagement between the sections. The dividers, in combination with each other and the carton walls form the six-cell configuration for the carton.

Further objects and advantages of the present invention will become apparent from the following detailed description taken in conjunction with the drawings, in which.

Figure 3:
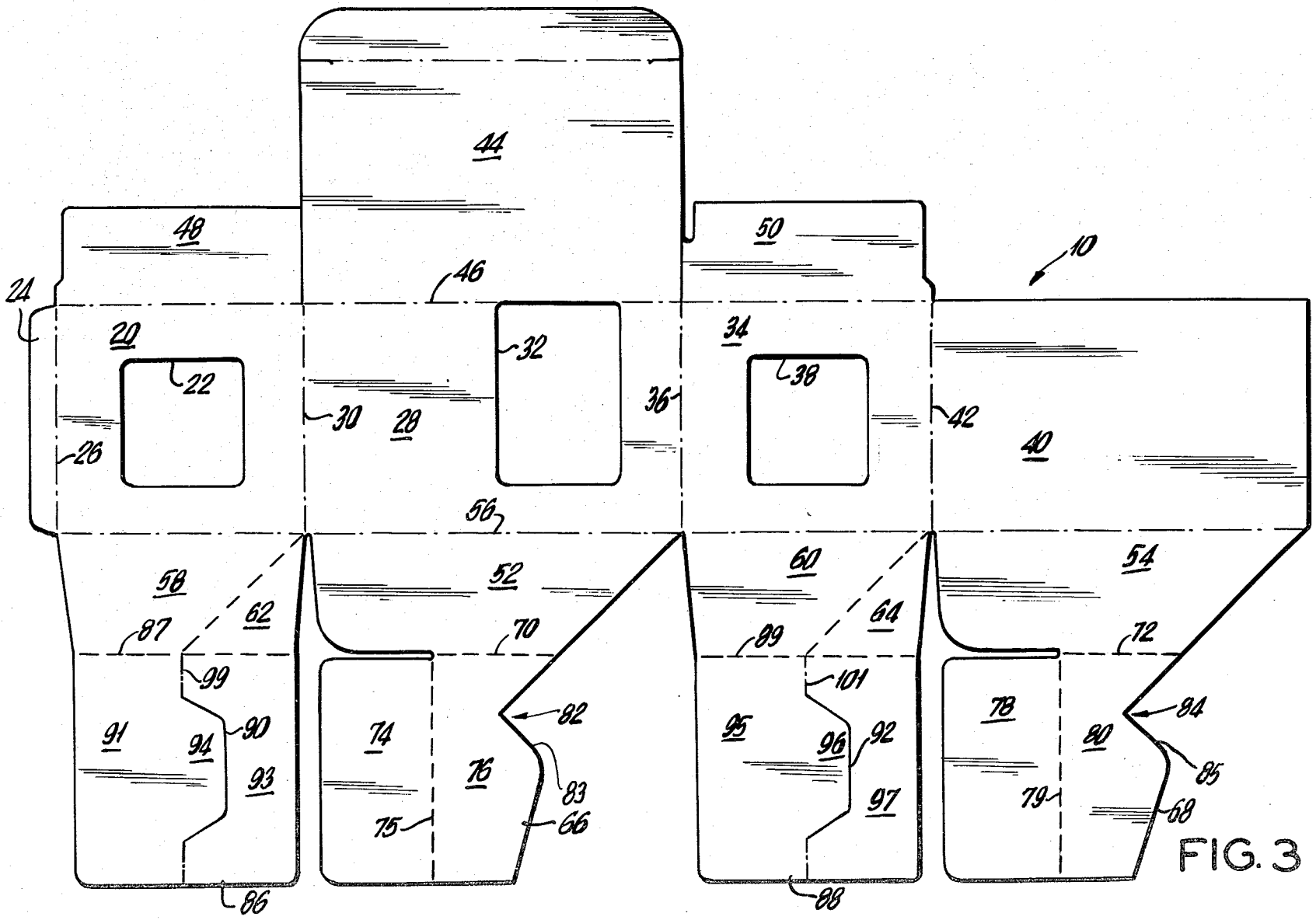
FIG. 3 is a plan view of the blank adapted to be folded into the carton of the subject invention.

Referring to FIG. 3, a plan view of the blank 10 adapted to be folded into the carton 12 of the subject invention is illustrated and includes a first side panel 20 with a central aperture 22 for viewing the articles contained in the erected carton 12. A glue flap 24 is hingedly connected to that first side panel 20 along fold line 26. A back panel 28 is hingedly connected along the opposed edge of first side panel 20 along fold line 30. Back panel 28 includes an aperture 32, also for viewing the articles within the erected carton 12. A second side panel 34 is hingedly connected to the back panel 28 along fold line 36. Second side panel 34 is similarly provided with an aperture 38 for viewing the articles contained within the carton 12. A front panel 40 is hingedly connected to the second side panel along fold line 42. A primary cover flap 44 is hingedly connected along the top edge of back panel 28 along fold line 46. First and second secondary cover flaps 48 and 50 are respectively hingedly connected to the first side panel 20 and the second side panel 34 along fold line 46.

Two first bottom panels 52 and 54 are hingedly connected to the bottom edges of back panel 28 and front panel 40 respectively, along fold line 56. Two second bottom panels 58 and 60 are respectively, hingedly connected along the bottom edges of the first side panel 20 and the second side panel 34 along fold line 56. Second bottom panels 58 and 60 each include a generally triangular portion 62 and 64 for forming an automatic locking bottom, as is well known in the prior art. Two first dividers 66 and 68 are respectively, hingedly connected to the bottom edges of the first bottom panels 52 and 54 along fold lines 70 and 72. Each first divider includes two sections 74, 76 (78, 80) which are hingedly connected along fold lines 75 and 79, respectively. The hinged sections are provided for forming the L-shaped configuration of the dividers in the erected carton 12. Sections 74 and 78 are respectively spaced from the first bottom panels 52, 54 to facilitate the movement of the dividers during erection of the carton 12. Sections 76 and 80 additionally include V-shaped notches 82 and 84 which are provided so that sections 76 and 80 can interengage during erection of the carton 12 providing increased structural rigidity for the central wall. Sections 76 and 80 are further provided with arcuately shaped edge portions 83 and 85 disposed below the notches 82 and 84. The arcuately shaped edge portions facilitate the interengagement between sections 82 and 84 as more fully described hereinafter.

Two second dividers 86 and 88 are respectively hingedly connected along the bottom edges of second bottom panels 58 and 60 along fold lines 87 and 89. Each second divider 86, 88 includes two sections, 91, 93, 95 and 97 which are hingedly connected along fold lines 99 and 101, respectively. Each second divider further includes cut lines 90 and 92 defining tab members 94 and 96 which are spaced from both the top and bottom edges of the second dividers 86 and 88. By providing for adequate spacing on either side of cut lines 90, 92, the structural integrity of the dividers, 86, 88 are maintained thus providing a stronger carton. The tab members 94 and 96 are provided to adhesively connect the second dividers 86 and 88 to the first dividers 66 and 68 respectively, in the erected carton 12, as more fully described hereinafter.

Figure 4:
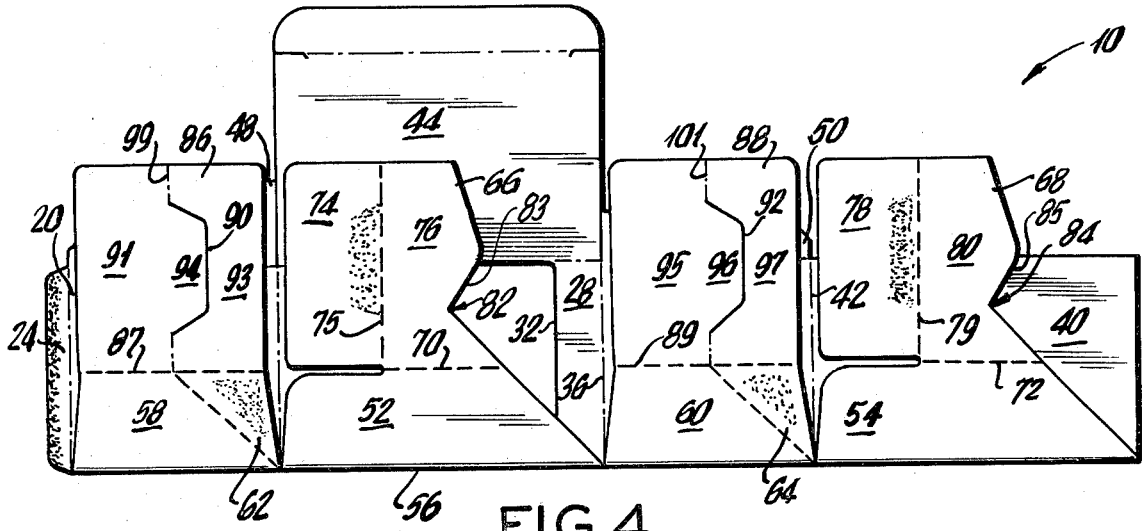
FIG. 4 is a plan view of the blank of the subject invention, illustrating a partial folding of the blank.

To form the carton 12 of the subject invention, the bottom panels 52, 54, 58 and 60 along with the dividers, 66, 68, 86, and 88 are folded upwardly along fold line 56, as illustrated in FIG. 4. Adhesive is applied to glue flap 24, triangular portions 62 and 64 of the second bottom panels 58, 60, and a central area of first dividers 66, 68 which is aligned respectively with tab members 94 and 96 in the next folding step.

In the next folding step, front panel 40 along with first bottom panel 54 and first divider 68 is folded along fold line 42 into contacting relation with second bottom panel 60 and second divider 88, and is adhesively joined thereto. In addition, first side panel 20 along with second bottom panel 58 and second divider 86 is folded along fold line 30 into contacting relation with first bottom panel 52 and first divider 66 and is adhesively joined thereto. Thereafter, glue tab 24 is adhesively joined to the free edge of front panel 40.

Figure 1:
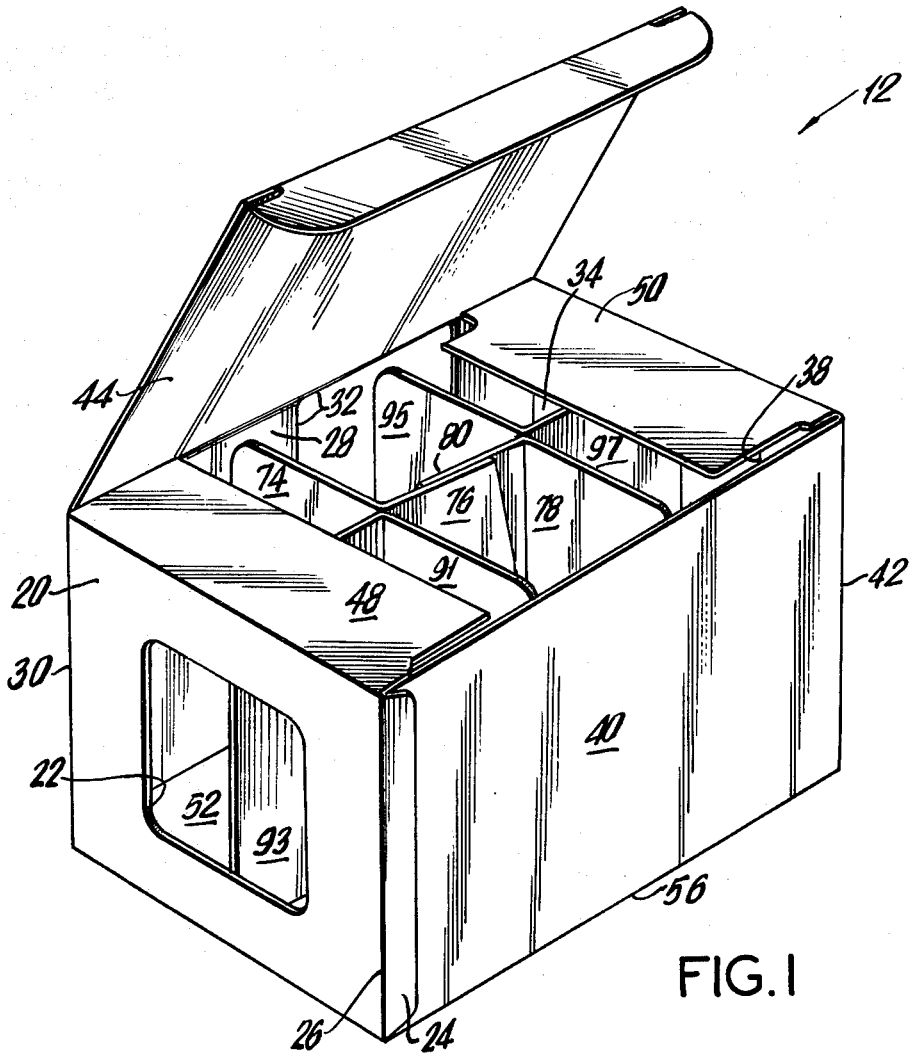
FIG. 1 is a perspective view of the carton of the subject invention.
Figure 2:
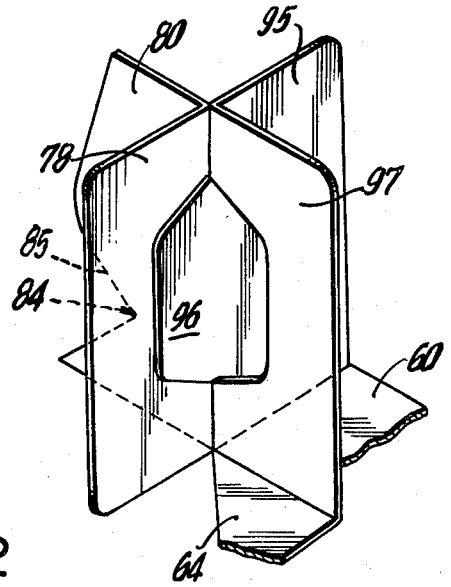
FIG. 2 is a partial perspective view, in section, illustrating the arrangement of one pair of L-shaped dividers.
Figure 5:
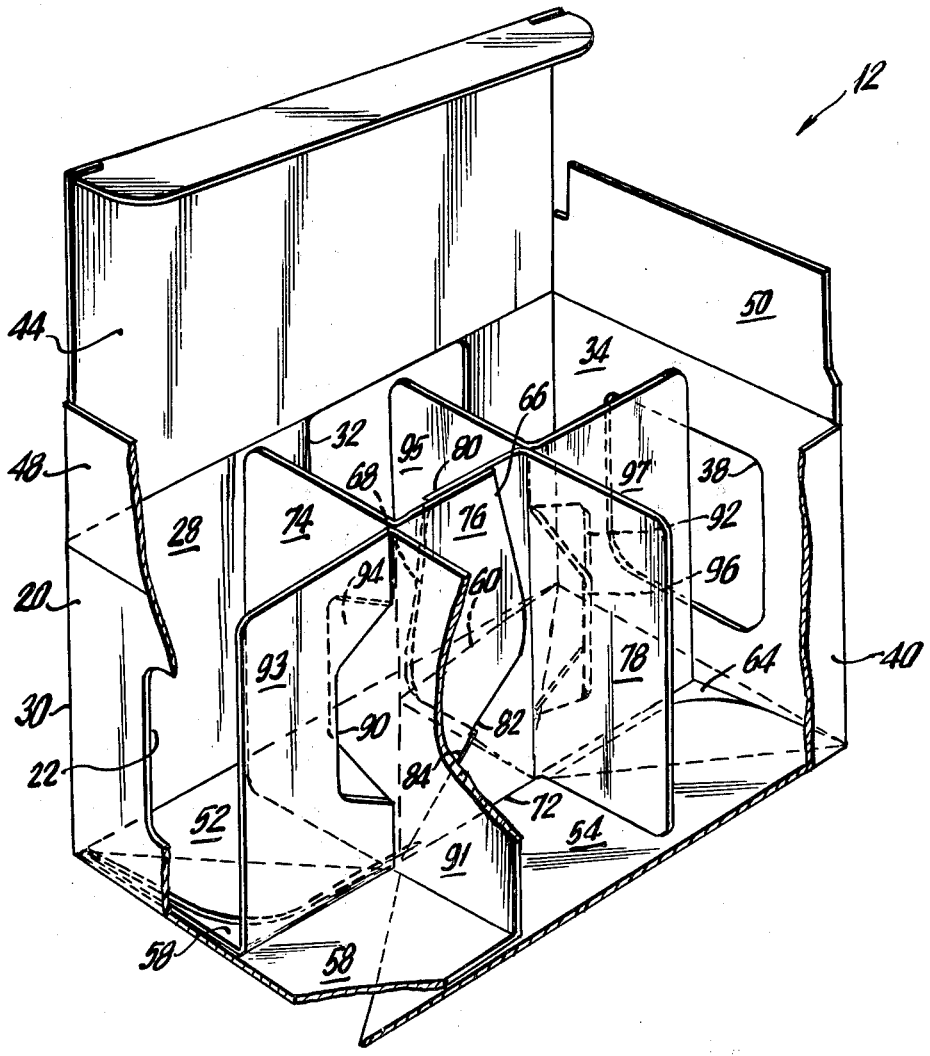
FIG. 5 is a sectional perspective view of the carton of the subject invention.

The carton 12 of the subject invention may then be shipped in this flattened configuration thereby reducing shipping costs. When the carton 12 is to be erected, the first side panel 20 and the front panel 40 are separated from the back panel 28 and the second side panel 34 which results in the automatic erection of the carton 12. More particularly, the bottom panels 52, 54, 58 and 60 automatically interengage to form a closed bottom wall, as illustrated in FIG. 5. As the carton 12 is being erected, the dividers unfold forming a pair of cross-shaped members, one of which is best illustrated in FIG. 2. More particularly, the cross-shaped pattern is created when the respective first and second dividers are forced into an L-shaped configuration with their respective central hinge lines 79, 101 (75, 99) in abutting relation. While both cross-shaped patterns are similarly formed, one pair of dividers is specifically described and is illustrated separately in FIG. 2. The cross-shaped pattern is formed during erection of the carton when bottom panel 60 pulls section 95 of the second divider into a perpendicular relation with the back panel 28 while first bottom panel 54 forces section 97 into parallel relation with back panel 28. At the same time, first bottom panel 54 pulls section 80 into parallel relation to the front panel 40, while the adhesive connection between section 78 of divider 68 and tab member 96 pushes section 78 into perpendicular relation with front panel 40. The movement of section 78 into perpendicular relation with front panel 40 is facilitated by the spacing provided between section 78 and first bottom panel 54, which eliminates any unnecessary friction. Thus, as illustrated in FIG. 2, a cross-shaped pattern is created consisting of two bonded L-shaped dividers. A second cross-shaped pattern is similarly created by the first and second dividers 66, 68, as illustrated in FIG. 5.

In addition, sections 76 and 80 of the first dividers 66, 68 are forced into an interengagement along the V-shaped notches 82 and 84 provided along the edges thereof. (See FIG. 5). This interengagement provides increased structural rigidity to the central wall portion created by the overlap of sections 76 and 80 at the center of the carton. The interengagement between sections 76 and 80 during erection of the carton 12 is facilitated by the arcuately shaped edge portions 83 and 85 which function to frictionally guide sections 76 and 80 into interengagement. Thus, it is seen that the two cross-shaped members which overlap and interengage along sections 76 and 80, in combination with the side walls of the carton 12 create a six-cell container for carrying fragile articles. Windows 22, 32, and 38 are provided for viewing the articles within the erected carton.

Accordingly, there is provided a collapsible six celled carton with dividers that extend the full height of the carton. The carton is capable of being shipped in a flattened configuration and is readily erected when needed. In addition, the carton has a new and improved divider arrangement which includes alternate pairs of L-shaped dividers which are adhesively bonded together via a tab means which is spaced from the top and bottom of the dividers. A section of each alternate pair of dividers stand in overlapping relation and are interengaged to form a structurally rigid central wall. The dividers in combination with each other and the carton wall form a six cell configuration which affords protection to the fragile articles within the carton.

Although the subject carton has been described by reference to a preferred embodiment, it is apparent that other modifications could be devised by those skilled in the art that would fall within the scope and spirit of the present invention as defined by the appended claims.

What is claimed is:

1. A collapsible six-cell carton comprising:

opposed side walls and opposed end walls hingedly interconnected at their side edges to form a tubular structure;

two first bottom panels, respectively hingedly connected to the bottom edges of said side walls;

two second bottom panels, respectively hingedly connected to the bottom edges of said end walls, said first and second bottom panels being interengaged to form a bottom for said carton;

two first dividers each of L-shaped configuration respectively hingedly connected to said first bottom panels and disposed perpendicular thereto; and two second dividers each of L-shaped congiruation respectively hingedly connected to said second bottom panels and disposed perpendicular thereto, said first and second dividers being of substantially the same height as said carton walls, each of said second dividers including a central cut line defining a tab means, said tab means being spaced from the top and bottom edges of said second dividers, one said tab means for fixedly connecting one said second divider to the adjacent said first divider to form a first cross-like divider member, the other said tab means for connecting the other said second divider to the other said first divider to form a second cross-like divider member, with one portion of each cross-like divider member being disposed in overlapping relation to create a central wall whereby said cross-like divider members cooperate with each other and with said carton walls to form a six-cell configuration.

2. A collapsible six-cell carton as recited in claim 1 made of a single sheet of cardboard blank.

3. A collapsible six-cell carton as recited in claim 1 further including a primary cover flap hingedly connected to the top edge of one of said side walls, and two secondary cover flaps respectively hingedly connected to the top edges of said end walls, said cover flaps being foldable to close the top of the carton.

4. A collapsible six-cell carton as recited in claim 1 wherein each said end wall and one said side wall include a central aperture for viewing the interior of said carton.

5. A collapsible six-cell carton as recited in claim 1 wherein each said overlapping portion of each cross-like divider member further includes a notch along a side edge thereof to create an interengagement between said portions to increase the structural rigidity of said central wall.

6. A collapsible six-cell carton as recited in claim 5 wherein each said overlapping portion of each cross-like divider member has an arcuately shaped side edge portion disposed above said notch to facilitate the interengagement of said overlapping portions during erection of said carton.

7. A collapsible six-cell carton formed from a single sheet of cardboard blank comprising:

opposed side walls and opposed end walls hingedly interconnected at their side edges to form a tubular structure;

two first bottom panels, resepectively hingedly connected to the bottom edges of said side walls;

two second bottom panels, respectively hingedly connected to the bottom edges of said end walls, said first and second bottom panels being interengaged to form a bottom for said carton;

a primary cover flap hingedly connected to the top edge of one of said side walls;

two secondary cover flaps each respectively hingedly connected to the top edges of said end walls, said cover flaps being foldable to close the top of said carton;

two first dividers of L-shaped configuration respectively hingedly connected to said first bottom panels and disposed perpendicular thereto; and two second dividers each of L-shaped configuration respectively hingedly connected to said second bottom panels and disposed perpendicular thereto, said first and second dividers being of substantially the same height as said carton walls, each of said second dividers including a central cut line defining a tab means, said tab means being spaced from the top and bottom edges of said second dividers, one said tab means for fixedly connecting one said second divider to the adjacent said first divider to form a first cross-like divider member, the other said tab means for connecting the other said second divider to the other said first divider to form a second cross-like divider member, with one portion of each cross-like divider member being disposed in overlapping relation to create a central wall and with each said overlapping portion of each cross-like divider member further including a notch along a side edge thereof for creating an interengagement between said portions to increase the structural rigidity of said central wall, each said overlapping portions further having an arcuately shaped side edge portion disposed above said notch to facilitate the interengagement of said portions during erection of the carton, such that said cross-like divider members cooperate with each other and with said carton walls to form a six-cell configuration.

8. A blank for forming a collapsible six-cell carton comprising:

a first side wall;

a first end wall hingedly connected along one edge to said first side wall;

a second side wall hingedly connected along the other edge of said first end wall;

a second end wall hingedly connected along the other edge of said second side wall;

two first bottom panels respectively hingedly connected to the bottom edges of said end walls;

two second bottom panels respectively hingedly connected along the bottom edges of said side walls;

two first dividers partially hingedly connected to the bottom edges of said first bottom panels respectively, and including two hingedly connected sections;

two second dividers respectively hingedly connected along the bottom edges of said second bottom panels and including two hingedly connected sections, said second dividers further including a cut line so as to define a tab which is spaced from the top and bottom edges of said second dividers.

9. A blank for forming a collapsible six-cell carton as recited in claim 8 further including a primary cover flap hingedly connected to the top edge of one of said side walls, and two secondary cover flaps respectively hingedly connected to the top edges of said end walls.

10. A blank for forming a collapsible six-cell carton as recited in claim 8 wherein each said end wall and one said side wall include a central aperture for viewing the interior of the erected carton.

11. A blank for forming a collapsible six-cell carton as recited in claim 8 wherein each first divider further includes a notch along a side edge thereof, and an arcuately shaped side edge portion disposed below said notch.

12. A blank for forming a collapsible six-cell carton as recited in claim 8 wherein said side walls, end walls and first and second dividers are of equal length.

13. A blank for forming a collapsible six-cell carton comprising:

a first side wall;

a first end wall hingedly connected along one edge to said first side wall;

a second side wall hingedly connected along the other edge of said first end wall;

a second end wall hingedly connected along the other side edge of said second side wall;

a primary cover flap hingedly connected to the top edge of one of said side walls;

two secondary cover flaps respectively hingedly connected to the top edges of said end walls;

two first bottom panels respectively hingedly connected to the bottom edges of said end walls;

two second bottom panels respectively hingedly connected along the bottom edges of said side walls;

two first dividers partially hingedly connected to the bottom edges of said first bottom panels respectively and including two hingedly connected sections, said first dividers further including a notch along a side edge thereof and an arcuately shaped side edge portion disposed below said notch;

two second dividers respectively hingedly connected along the bottom edge of said second bottom panels and including two hingedly connected sections, said second dividers further including a cut line so as to define a tab which is spaced from the top and bottom edges of said second dividers, said side walls, end walls and first and second dividers being of equal length.

* * * * *